US005467676A

United States Patent [19]

Hooper et al.

[11] Patent Number: 5,467,676

[45] Date of Patent: Nov. 21, 1995

[54] AUTOMATIC ROLL WRAPPER REMOVING APPARATUS AND METHOD

[75] Inventors: Steven C. Hooper, Hoquiam; Norman E. Dornblaser, Shelton, both of Wash.

[73] Assignee: Lamb-Grays Harbor Co., Hoquiam, Wash.

[21] Appl. No.: 91,611

[22] Filed: Jul. 14, 1993

Related U.S. Application Data

[63] Continuation-in-part of Ser. No. 744,292, Aug. 13, 1991, abandoned.

[51] Int. Cl.[6] ..... B26D 7/14

[52] U.S. Cl. ..... 83/24; 83/27; 83/56; 83/98; 83/365; 83/614; 83/649; 83/924; 83/176

[58] Field of Search ..... 83/24, 27, 42, 83/56, 73, 98, 902, 368, 924, 365, 909, 649, 614, 176; 414/412; 242/562, 562.1

[56] References Cited

U.S. PATENT DOCUMENTS

| | | | |
|---|---|---|---|
| 2,168,419 | 8/1939 | Paterson | 198/20 |
| 2,918,773 | 12/1959 | Krupp et al. | 53/382 |
| 3,050,917 | 8/1962 | Verhoeven | 53/381 |
| 3,057,497 | 10/1962 | Stadelman | 214/309 |
| 3,068,622 | 12/1962 | Brownlee | 53/50 |
| 3,121,300 | 2/1964 | Rossi | 53/56 |
| 3,521,347 | 7/1970 | Bentley | 29/427 |
| 3,744,214 | 7/1973 | Dolce et al. | 214/305 |
| 4,158,417 | 6/1979 | Inoue | 53/381 R |
| 4,298,173 | 11/1981 | Johansson | 242/55 |
| 4,579,293 | 4/1986 | Steiniger | 226/92 |
| 5,386,751 | 2/1995 | Dylla et al. | 83/24 |

FOREIGN PATENT DOCUMENTS

| | | | |
|---|---|---|---|
| 0528351 | 2/1993 | European Pat. Off. | B65B 69/00 |
| 2010771 | 7/1979 | United Kingdom | B65B 69/00 |

*Primary Examiner*—Rinaldi I. Rada
*Assistant Examiner*—Allan M. Schrock
*Attorney, Agent, or Firm*—Seed and Berry

[57] ABSTRACT

Method and apparatus for cutting a wrapper on a cylindrical roll in which a blade has a pointed tip joined to an inclined edge extending outwardly and an opposite smooth surface, the blade being moved under the outer wrap of the wrapper but outward of the material of the roll and continuing to be moved along a predetermined path along the length of the roll, with the inclined edge cutting the outer wrapper. The blade is positioned perpendicular to the roll and circumferentially from the outer end of the wrapper. In a preferred embodiment a longitudinal bubble is formed in the outer wrap of the wrapper and the blade tears through the crown of this bubble. Also in the preferred embodiment, a gathering device is provided for removing and flattening the cut wrapper.

29 Claims, 12 Drawing Sheets

FIG. 14
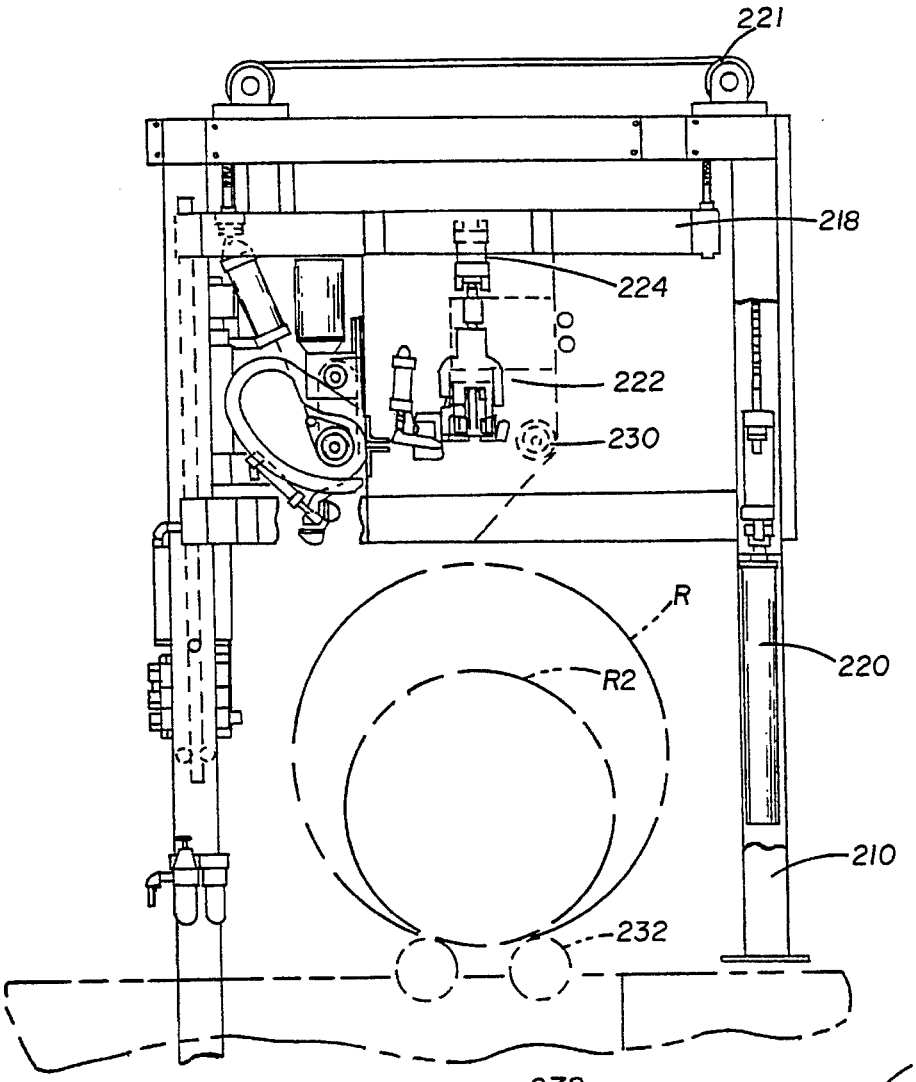
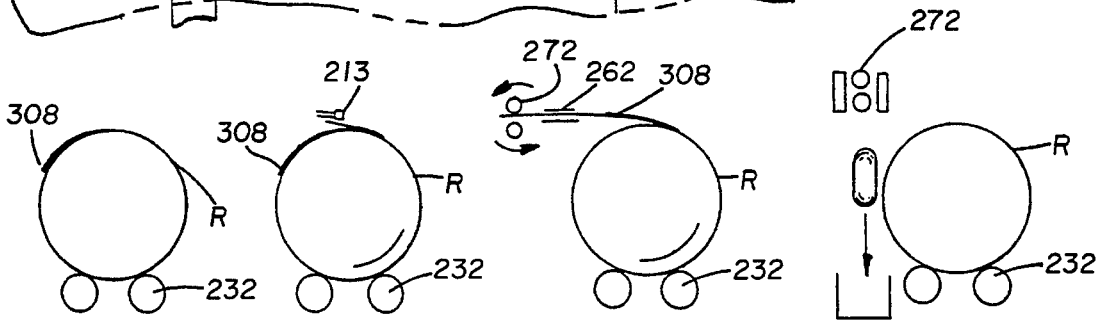
FIG.23A FIG.23B FIG.23C FIG.23D

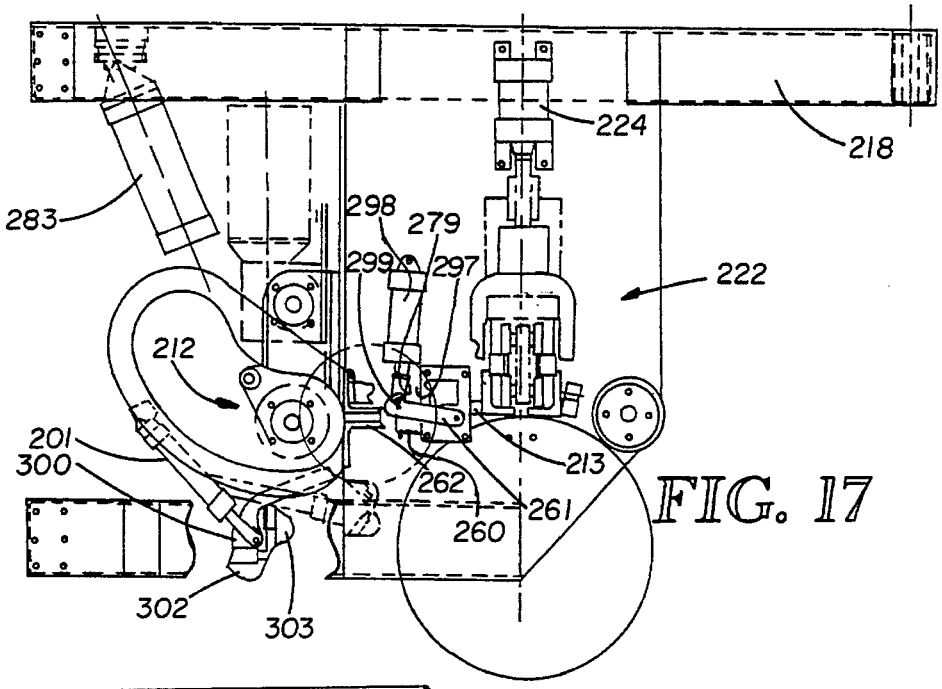
FIG. 17
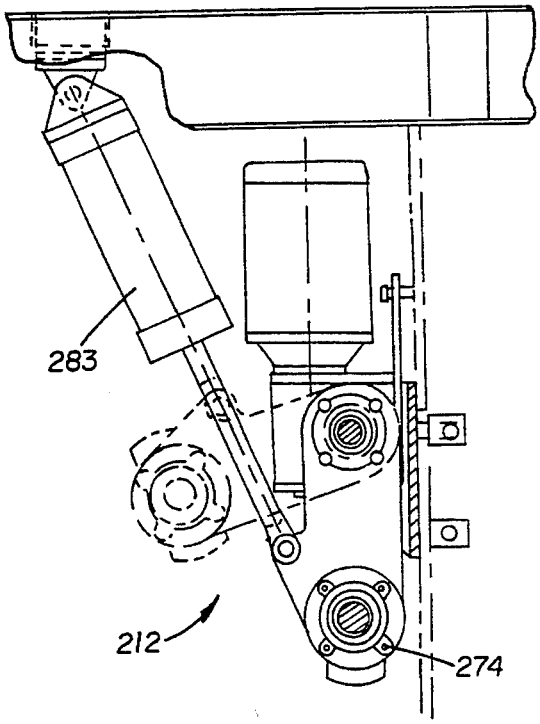
FIG. 18
FIG. 19
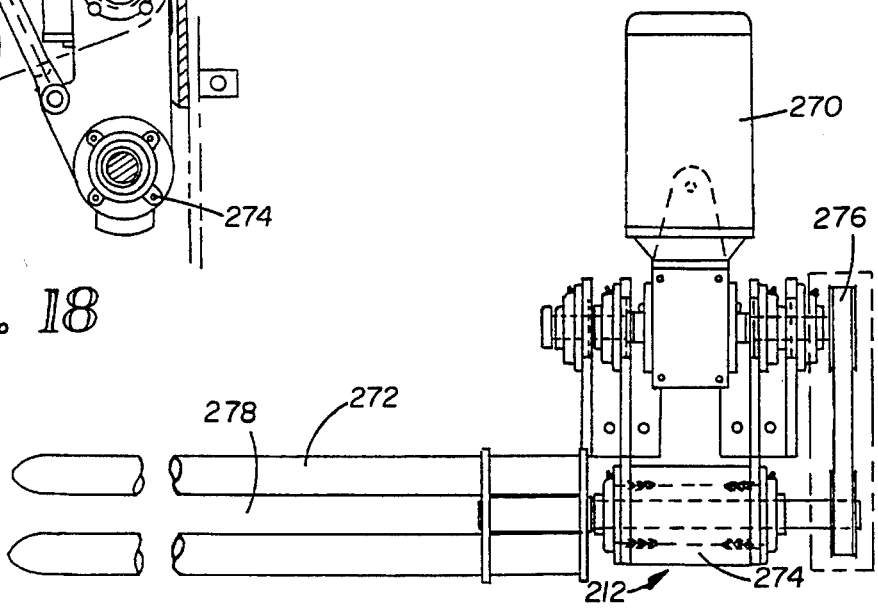

AUTOMATIC ROLL WRAPPER REMOVING APPARATUS AND METHOD

TECHNICAL FIELD

This invention pertains to apparatus and method for automatically removing the wrapper from a cylindrical roll such as a roll of paper such as newsprint paper.

CROSS-REFERENCE TO RELATED APPLICATION

This application is a continuation-in-part of U.S. patent application Ser. No. 07/744,292, filed Aug. 13, 1991, now abandoned.

BACKGROUND OF THE INVENTION

Paper rolls are wrapped with one or more layers of heavy wrapping paper to protect the surface of the outer layers of paper on the roll. The wrapped roll usually (but not always) includes "heads," namely, a disk of paperboard at each end of the roll, which must be removed by another process, manually or mechanically. The remaining wrapper is referred to as the "sleeve." For the purposes of this application the paper on the roll will be described as newsprint paper although the invention pertains to any roll protected by a wrapper. Various ways have been employed to cut the wrapper from the roll. One technique is for a workman to merely take a knife, press the blade inwardly against the outer surface of the wrapper at one end of the roll and slice through the wrapper from end to end on the roll. This technique can be injurious to the workman and frequently results in some of the newsprint paper being cut also. This newsprint paper is then wasted.

Another manual technique for cutting the wrapper is to start a blunt sloped knife under the outer wrapper and manually push the knife from one end of the roll to the other through the wrapper. This technique tends to be more certain of not cutting the newsprint but is time-consuming and if the workman is not careful the cutting tool can also engage the newsprint damaging the outer layers of newsprint paper.

Attempts have been made to automate the wrapper cutting procedure. Generally, these automated techniques have used a motor driven rotary cutting blade which is lowered onto the wrapper and moved from one end of the roll to the other. The rotary cutting blade tends to frequently cut through the wrapper, into the newsprint paper damaging the newsprint paper.

In automated handling of rolls it is desirable to not only save labor but reduce the waste caused by manual or powered cutting tools cutting into the newsprint paper. The saving of two or three wraps of newsprint paper often adds up to savings of tens of thousands of dollars in a single year. It is also desirable to put the heavy wrapper removed into a convenient form for handling and disposal. Disposal is typically by baling for recycling.

SUMMARY OF THE INVENTION

It is an object of this invention to automate the roll unwrapping process.

It is another object of this invention to automate the roll unwrapping process and at the same time minimize the waste caused when an operator or powered wrapper cutter slits through the wrapper and damages the newsprint paper.

Yet another object of this invention is to provide a means for placing the removed wrapper in condition for convenient handling and disposal.

The objects are obtained in a preferred embodiment by pinching an outer wrap of the protective wrapper along a line parallel to the longitudinal axis of the roll to form a bubble and moving a knife along and through the crown of the pinch or bubble under the wrapper to slit or tear the wrapper at the pinch from the inside out. In this way the knife can effectively slit through the outer wrapper only. In addition to cutting the wrapper, the invention also removes the cut wrapper and discharges the cut wrapper at a location remote from the paper roll.

Various features of the invention are uniquely provided for creating accurate pinching pressure and stroke on rolls of different softness or other variations, flattening the gathered removed wrapper for convenient disposal, and detecting an outer end edge of a wrapper on a roll.

In a second embodiment the knife is guided beneath the surface of the outer wrap of the wrapper by a gauging member that rides on the outer wrap of the wrapper.

BRIEF DESCRIPTION OF THE DRAWINGS

FIG. 14 is an end elevation of the second embodiment.

FIG. 17 is an enlarged detail of the second embodiment.

FIG. 18 is an enlarged detail of the second embodiment.

FIG. 19 is a front elevation of the apparatus shown in FIG. 18.

FIGS. 23A–23D are schematic illustrations showing the second embodiment steps of removing the wrapper.

DETAILED DESCRIPTION OF THE INVENTION

Figure 1:
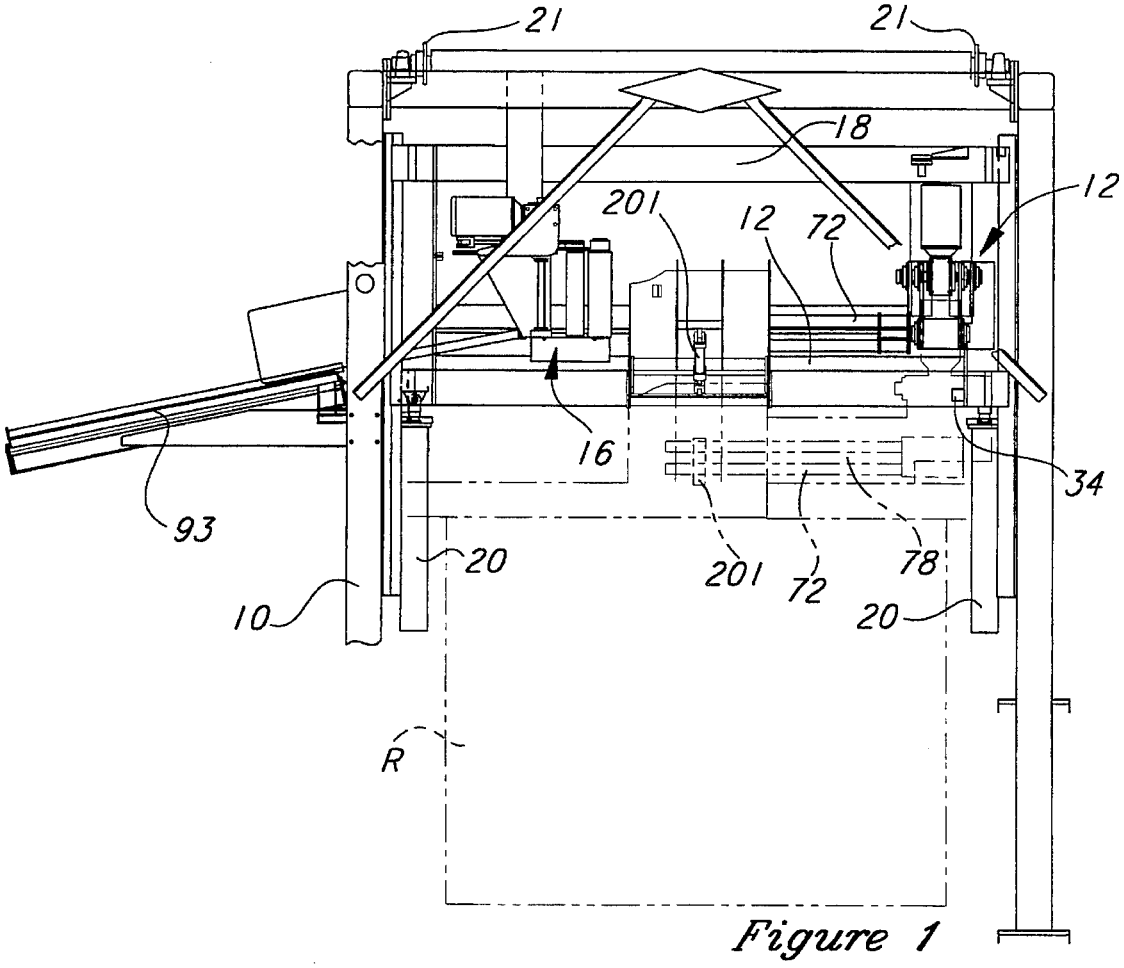
FIG. 1 is a front elevation of a preferred apparatus for cutting and removing the wrapper.
Figure 12:
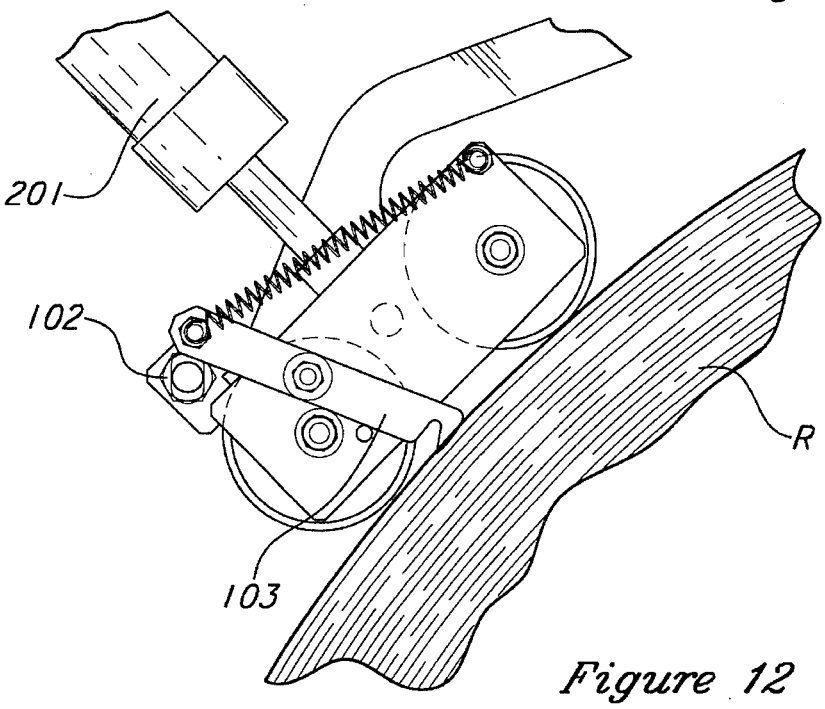
FIG. 12 is a fragmentary view of a preferred sensor for locating the outer or trailing edge of the wrapper.

FIGS. 1–12 illustrate the preferred embodiment of the invention. FIG. 1 shows a mainframe 10 having a cut wrapper collecting mandrel 12, an air shower 13 (FIG. 3) for guiding the cut wrapper into the mandrel assembly, and a wrapper removing assembly 16 for stripping the cut wrapper from off of the mandrel assembly 12.

Figure 2:
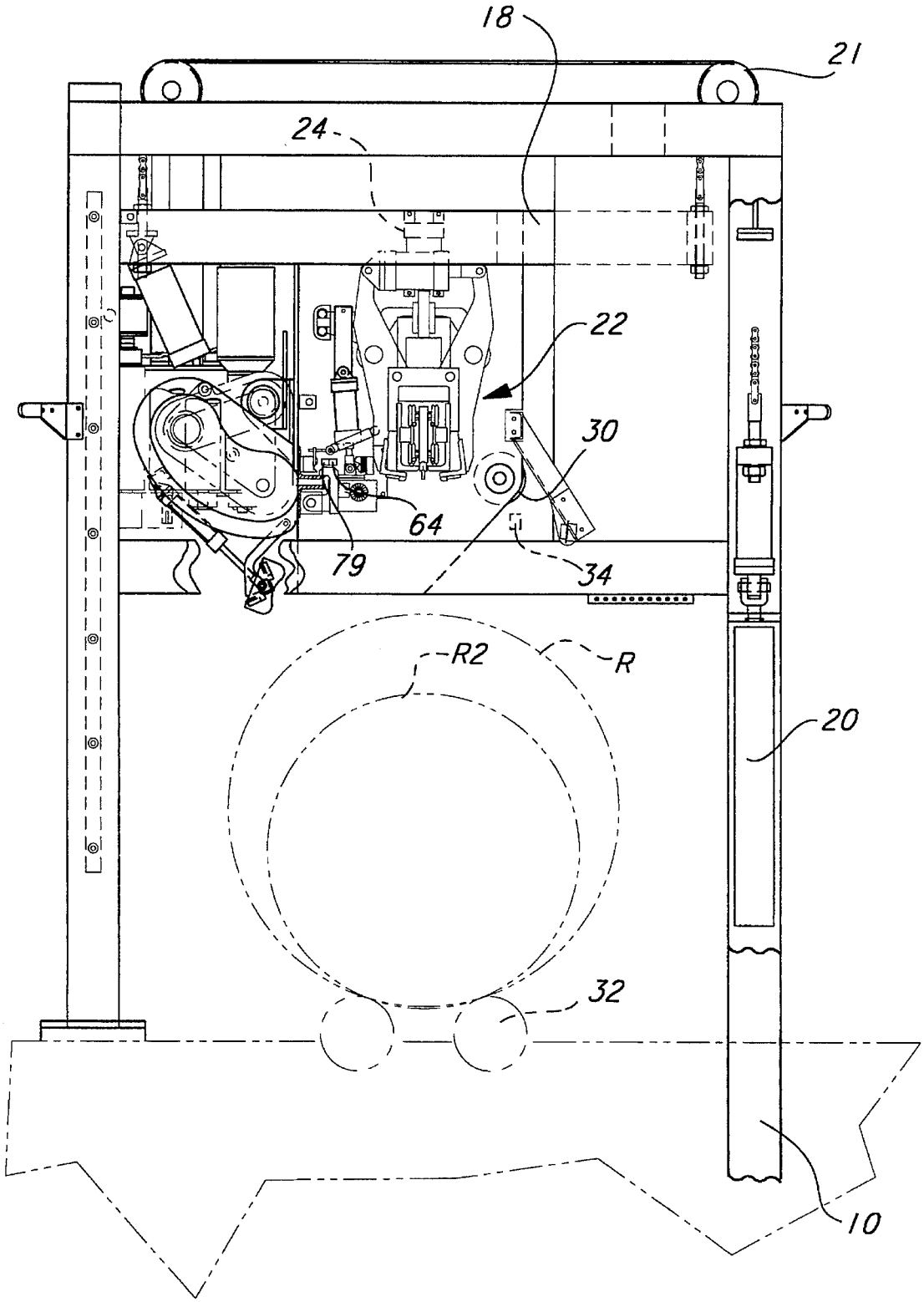
FIG. 2 is an end elevation of the preferred embodiment.

As best shown in FIG. 2, the mainframe 10 also supports a cutter carriage 18 vertically and reciprocally mounted. A pair of pneumatic cylinders 20 raise and lower the carriage via chains and sprockets 21.

A movable cutter assembly 22 is raised and lowered on the carriage 18 by a pair of pneumatic cylinders 24.

Figure 11A:
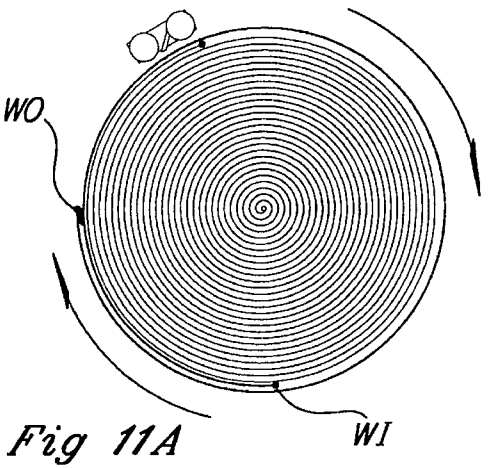
FIGS. 11A–11F are schematic illustrations showing the preferred embodiment steps of removing the wrapper.

As will be described in more detail below, a wrapped paper roll will then be rotated in the unwind direction at slow speed until the outer or trailing edge of the wrapper is located approximately at eleven o'clock on the end of the roll as viewed, for example, in FIG. 11A. As is well understood, the roll will have a wrapper of one or more wraps surrounding the higher quality paper in the roll. For purposes of this description, the unwind direction of the roll is the direction which tends to untighten or unwind the roll. This is the clockwise direction in FIG. 11A. The wind direction of a roll is the direction which tends to tighten the roll into a tighter coil. This is the counterclockwise direction as viewed in FIG. 11A.

The carriage 18 is provided with a rider roller 30 which will move down with the carriage toward the paper roll R located on a pair of rotatable turning rollers 32. The rollers 32 are capable of handling wrapped rolls of various diameters, such as the second wrapped roll shown in phantom lines R2.

Once the cutter assembly is positioned onto the roll, the four pneumatic cylinders 24 and 25 are further pressurized to push a set of gripper bars 26 tightly against the roll. The gripper bars are elongated steel-backed urethane pads running the length of the roll. The pads have a slight curvature as at 26*a* that is along a radius 26*b* from a pivot point 29 of gripper arms 27 that carry the gripper bars and pads. The urethane material of the gripper pads is preferably of a 45 durometer (shore "A") to provide a gripper pad with enough compliance to conform to surface deformities of the roll R. This enhances frictional bond to minimize slippage of the grippers along the surface of the wrapper on the roll. Urethane is reasonably dense and not porous. Thus, it offers the advantage of being durable, while minimizing pick-up of product fibers which would otherwise cause the pad to become coated and lose its frictional characteristic. The downward pressure applied by the cylinders 24 and 25 enhances this gripping force between the gripper bars and the wrapper for good frictional contact.

Figure 11B:
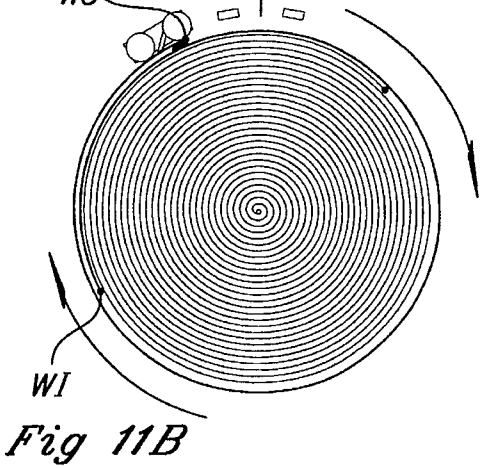
Figure 11C:
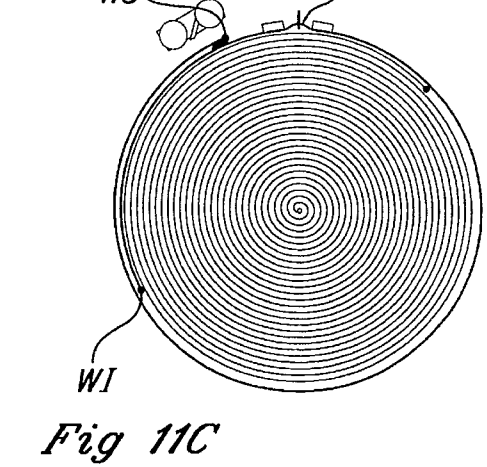

Once the grippers are in tight contact with the wrapper, the cylinders 28 that pivotally engage the arms 27 are extended pivoting the gripper arms toward one another (FIG. 3) to create a pinch or bubble B as best shown in FIG. 11C.

Several adjustments can be made to the amount of pinching by the gripper arms 26. The arms 27 that are pivoted by cylinder 28 have adjustment plates 106 rigidly attached to them. The adjusting plates each have an adjustable end screw 107 that contacts a cam pad 108 on a rotatable cam disk 109. The rotatable cam disk has four different thicknesses of cams or pads which can be engaged by the adjusting screw. Thus, the amount of pinching can be roughly controlled by quickly rotating the cam disk to the desired cam pad thickness and adjusting the screw 107 to the fine adjustment thickness. Adjustable stops 110 near the gripper bars 26 provide a limit for the closed gap of the gripper bars while the cam disk adjusts the open extent of the gripper bars. The thicknesses of the cam pads to adjust the stroke of the gripper pads are sized such that each adjustment step equals approximately one quarter the effect of the stroke potential. The adjustment screws provide the infinite range adjustment for the amount of open position of the gripper arms.

The cam disc provides self-centering of the grippers in the open position, which assures that the bubble will form directly vertical of the roll center line. The grippers are closed to an adjustable closed position by the adjustment screws 110. These provide for an infinite closed position adjustment through an approximate one-inch total range one-half inch on each side.

Both the closed and open adjustments are set to optimize the bubble size for consistent cutting, regardless of the many roll variables. These variables can be the hardness of the roll, tightness of the wrap, number of wraps, the type of the inner edge WI attachment to the roll, whether it is tape, hot melt glue, cold glue, a static charge, etc., the type of the attachment of the outer edge of wrapper WO, the wrapper material quality and physical properties, and whether end bands are used single or double. End bands are bands around the circumference of the wrapper at either end of the roll and are occasionally used on wrapped rolls of paper.

As examples, each paper manufacturer may produce a different roll characteristic. One typical roll is considered to be usually soft and has a cold glue attached inner edge WI, a outer end WO which is taped to the paper roll, and relatively low quality wrapper. A minimal gripper stroke is used to form the bubble with the roll of these characteristics. A maximum bubble height of, for example, one quarter of an inch may be expected with such a soft roll.

Another typical roll is considered to be a usually hard roll and may have a static attachment to the leading edge, a heavy laminated wrapper material, a hot melt trailing edge and end bands on both ends with the wrapper also being of high quality. A maximum length gripper stroke is required to form a bubble in such a roll of these characteristics. The bubble height will generally be less than one quarter of an inch with a hard roll.

If too great a stroke is used with the softer roll, the bubble becomes too big and there is a risk of cutting newspaper on the roll. If too short a stroke setting is used on the harder roll, the bubble is too small and the wrapper may not be reached along its full length by the cutter blade.

The carriage 18 will move down until the rider roller 30 is nominally close to the roll. A proximity photo switch 34 will sense this condition of proximity to the roll and the carriage position will then be held by a conventional pneumatic circuit lock for the pneumatic cylinders 20.

Figure 3:
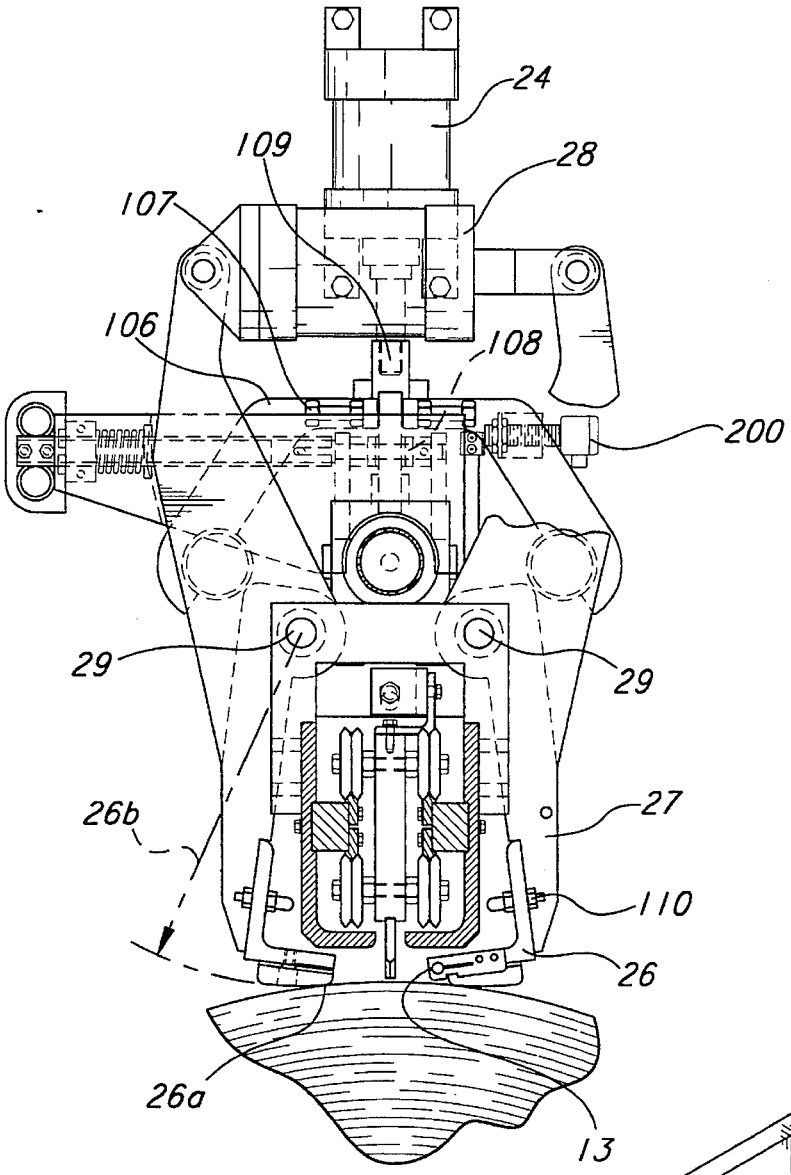
FIG. 3 is an end elevation of a portion of the preferred embodiment showing the wrapper cutting blade just prior to creating a bubble.
Figure 10:
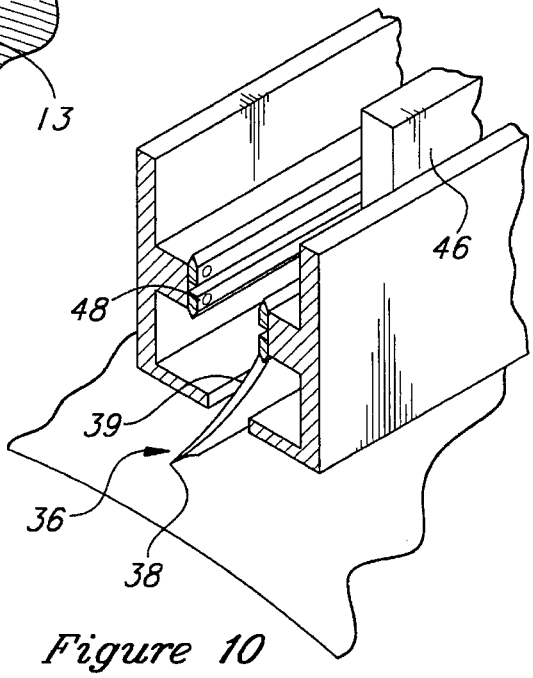
FIG. 10 is an isometric of the cutting blade of the preferred embodiment.
Figure 4:
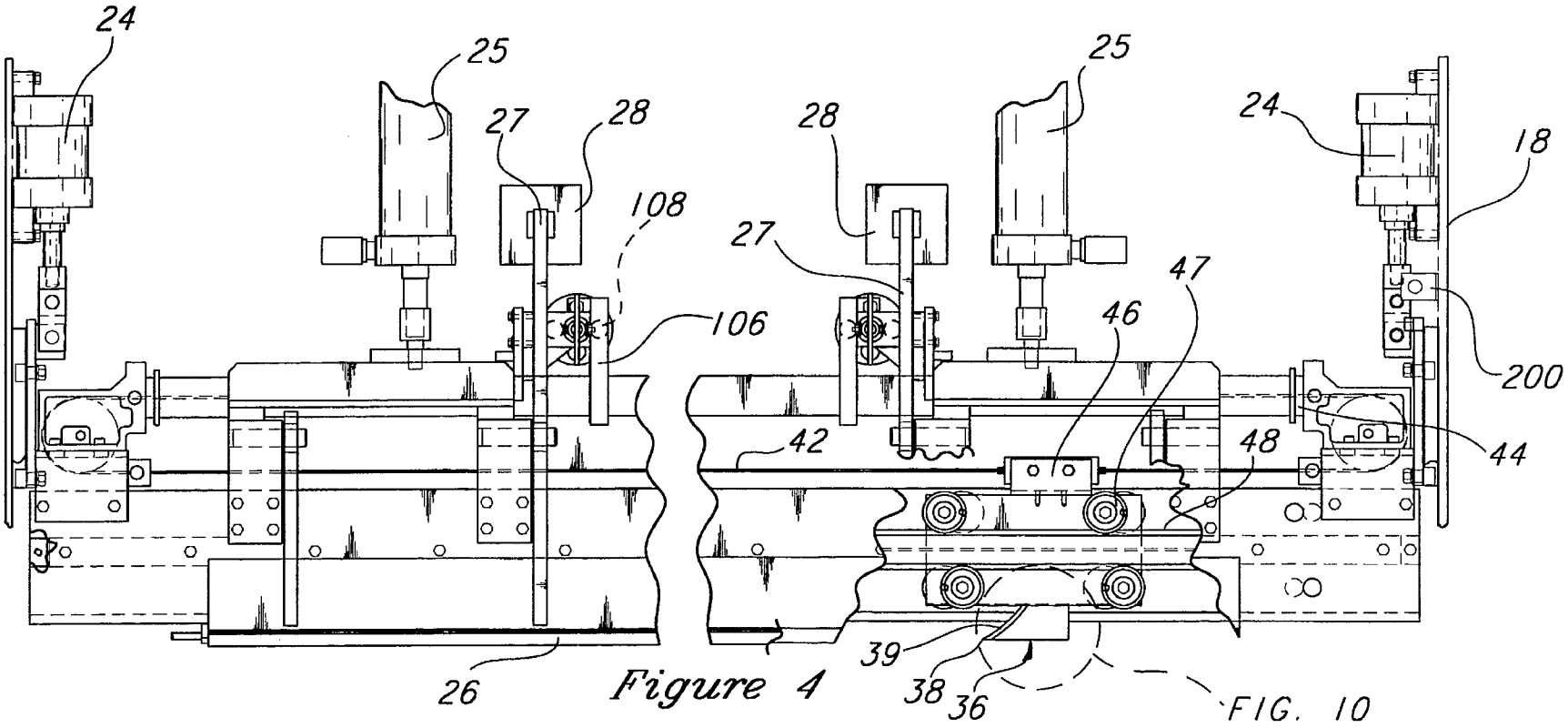
FIG. 4 is a side elevation of a portion of the preferred wrapper cutting apparatus.

The cutter assembly 22 is moveably supported on the carriage 18 and is best shown in FIGS. 3 and 4, the cutter assembly carries a movable cutter blade 36. The cutter blade 36 has a beveled tip 38 sloping up and rearwardly to an edge 39. The blade is intended to be slipped in under the upper crown of the bubble in the outer wrap, but above the surface of the next inward layer of wrapper or paper on the roll itself. The blade is then moved across the length of the roll tearing the crown of the bubble to separate the outer wrap into two pieces.

The cutter blade 36 is propelled through the bubble from one end of the roll to the other by an endless cable drive 42 (FIG. 4) driven by a pneumatic cylinder and cable 44. The cable is fixed to a trolley 46 having a plurality of guide wheels 47 that move on a guide track 48. Thus, by actuating the pneumatic cylinder 44, the blade can by moved along the guide track beyond the full length of a roll.

Figure 11D:
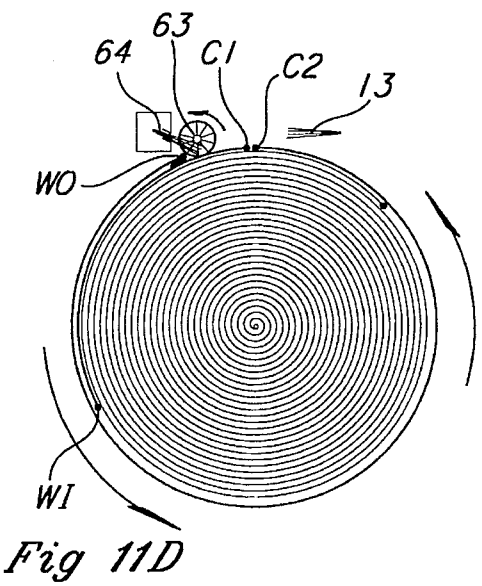
Figure 11E:
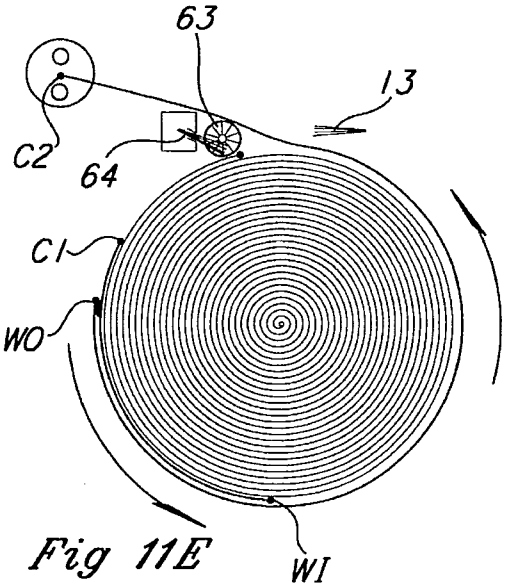
Figure 11F:
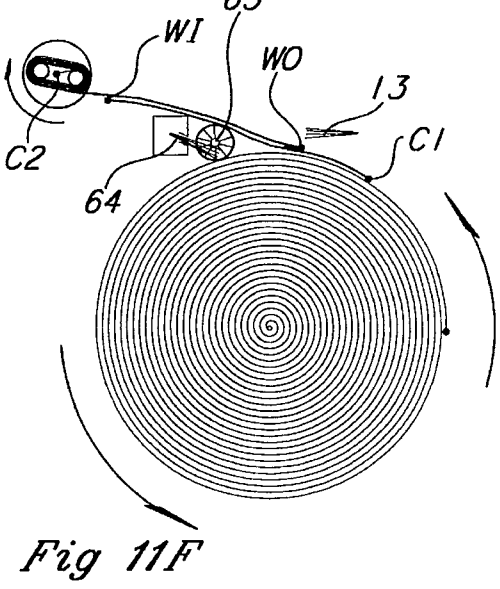

Once the roll wrapper has been cut all along its length, the cutter blade is retracted to its original position spaced endwise from the roll, the cutter carriage 18 is raised, and the rollers 32 are rotated to rotate the roll R in the wind direction as shown in FIG. 11D.

As best shown in FIGS. 5 and 11D–11F, the air shower 13 tube then emits a generally horizontal stream of air to the left as shown in FIG. 11D. As the air passes over the cut right side, free end C2 of the wrapper, the free end is lifted by the air stream and guided into a guide slot 62. Concurrently, a brush 63 is lowered onto the wrapper by cylinder 98. A second air shower 64 directs a stream of air to the right as shown in FIG. 11D through the bottom of the brush, the brush is rotating counterclockwise such that when the free cut end C2 of the wrapper is moved toward the left, it is separated and lifted from the roll by the combination of the air shower 13, the air shower 64 and if necessary the brush 63. This directs the cut end C2 upward past a guide plate 65 into the guide slot 62. The brush 63 rotates at a high speed in counterclockwise direction in contact with the roll to create a peeling effect on the free leading edge C2. After passing through the slot 62, the free end C2 of the wrapper enters the gap between spaced forks 72 of the cut wrapper collector mandrel assembly 12.

A wrapper sensing photo sensor 79 signals the presence of the wrapper just before it enters the coiling mandrel 12. After a short delay the mandrel will start to rotate clockwise as in FIG. 11E.

Figure 6:
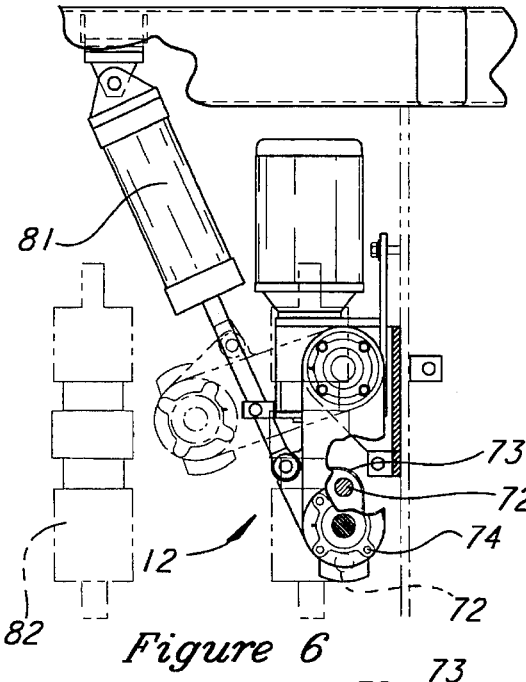
FIG. 6 is an enlarged detail section of the preferred wrapper removal apparatus taken along lines 6—6 of FIG. 7.
Figure 7:
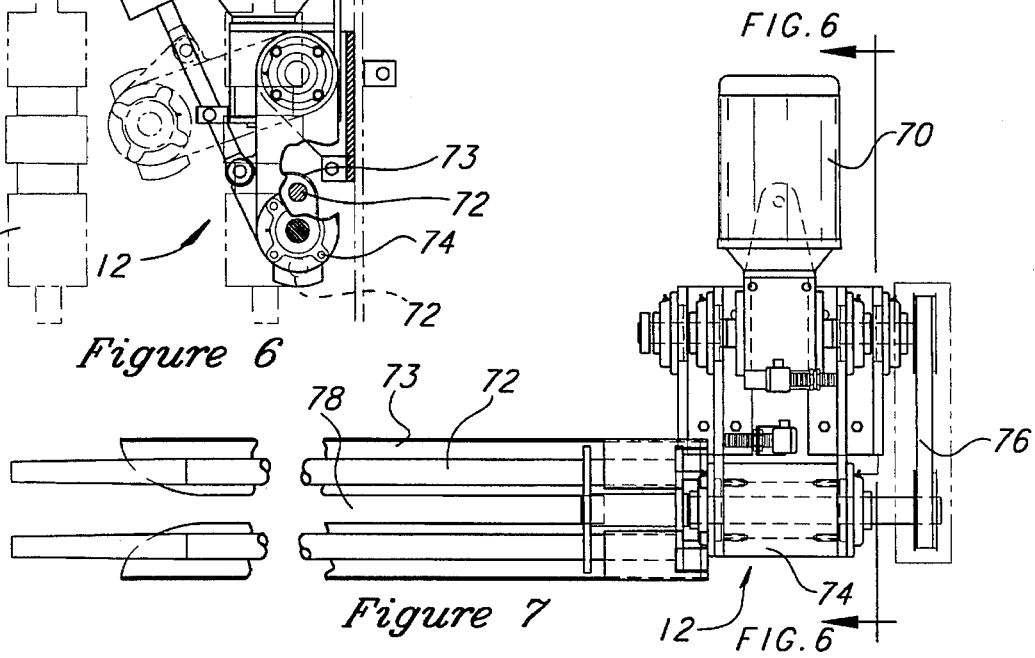
FIG. 7 is a plan of the apparatus shown in FIG. 6.

The mandrel is best shown in FIGS. 6 and 7 and includes a motor 70 that rotates a pair of forks 72 carried on a spindle 74. The spindle is driven by a drive belt 76 driven by the motor. The cut wrapper is then fed through the gap or nip 78 between the forks and as the forks rotate the wrapper becomes wrapped around the forks in a coil. A guide plate 73 is positioned behind each fork to assist in guiding the cut wrapper into the path of the forks.

The mandrel motor is operated by a variable speed controller. It will accelerate to speed, then decelerate at a rate which prevents over-tightening of the wrapper coil. This rate is determined by the speed of the rollers 32. Nominally, when the unwrap process is about three-quarters complete, the leading edge or innermost edge W1 (FIG. 11E) of the wrapper will approach the brush 63. This edge W1 will then also be peeled from the roll just as the cut edge C2 was. The glue holding the inner end of the wrapper W1 to the roll should release and the inner end of the innermost wrap of the wrapper should pull free. As the remaining or leftmost free cut end C1 of the wrapper feeds past the wrapper sensing photo sensor 79, the sensor will open a circuit, stopping the turning rolls 32 thus bringing rotation of the roll R to a stop and starting a short time delay. After this delay, the mandrel motor will slowly rotate counterclockwise for two or three revolutions finally stopping such that the forks are vertically indexed one above the other. This process tends to unwind or loosen the coil slightly on the forks to facilitate axial removal or stripping of the coil off the forks.

A cylinder 81 swings the motor and forks clockwise as shown in FIG. 6 away from the roll and raises it into alignment with the collecting roller assembly 16.

Figure 8:
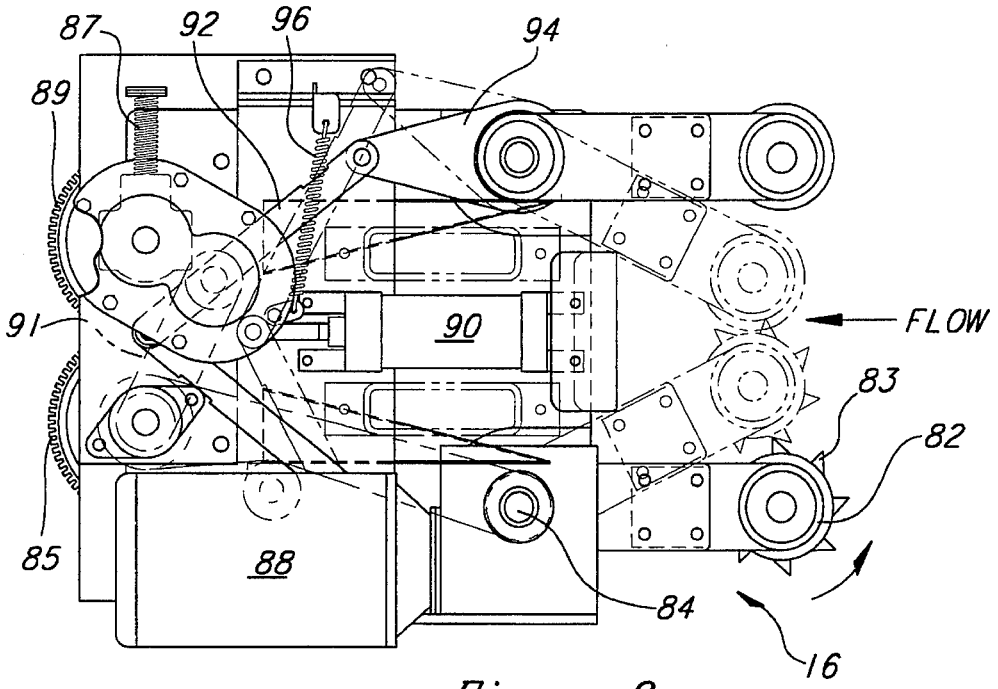
FIG. 8 is a plan of the preferred apparatus for removing the wrapper from the wrapper collecting mandrel.
Figure 9:
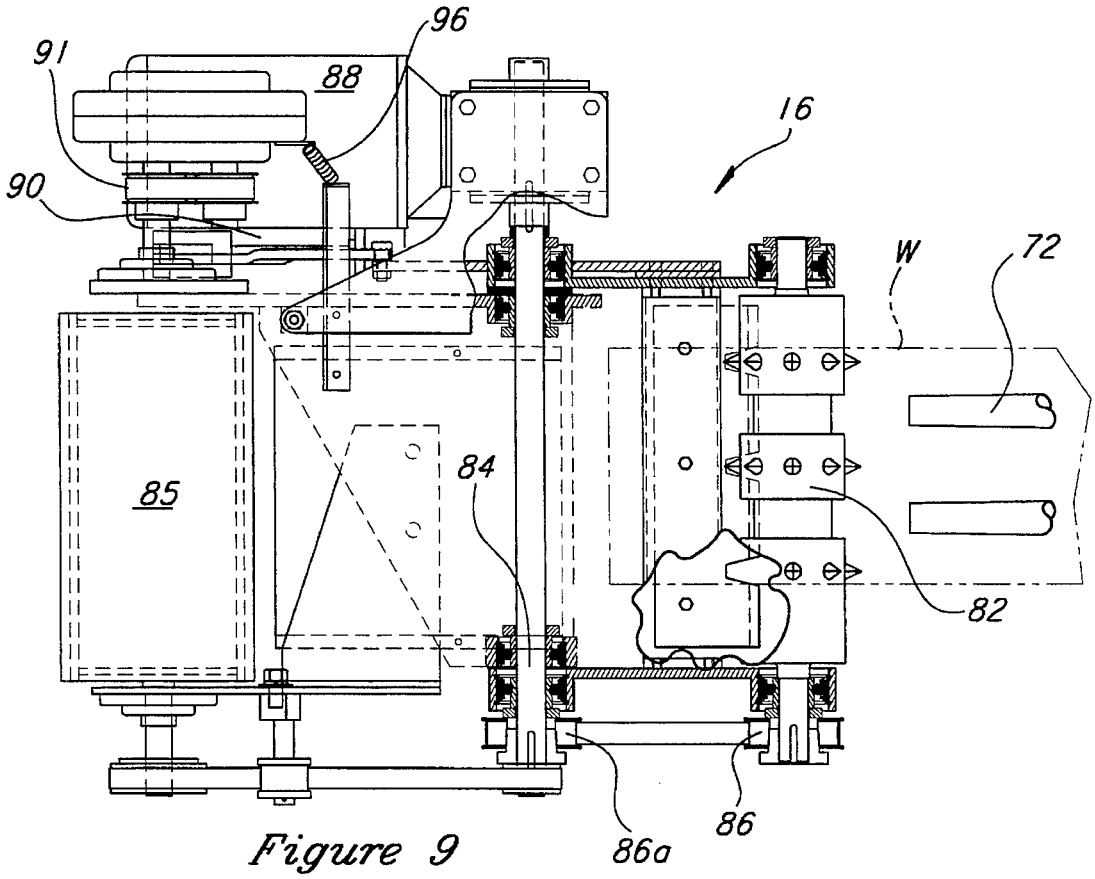
FIG. 9 is a side elevation of the apparatus shown in FIG. 8.

The collecting roller assembly 16 is best shown in FIGS. 8 and 9 and includes a set of vertical pinch rollers 82. One of the rollers is provided with a set of gripping points 83. The rollers are rotatably mounted on pivot rods 84 and one roller is rotatably driven by a belt 86. The belt is carried on sheave **86*a* fixed to the pivot rod 84. The pivot rod is rotated by a motor 88. A cylinder 90 connects to linkages 92 and 94 to pivot the rollers toward one another. One roller 82** is driven so that the wrapper can be caught between the nip between the two rollers when the rollers are moved toward one another. The gripping teeth will perforate the wrapping coil, thus developing additional traction forces. The wrapper is thus pulled or stripped off of the mandrel forks.

A pair of pinch rollers 85 and 89 are mounted downstream (to the left in FIG. 8) of the collecting rollers 82. The tractive force of the collecting rollers effectively pushes the coil into the pinch rollers, which are also belt driven off of the pivot rod 84. The driven roller 85 of this pair is spatially fixed, whereas the idler roller 89 is spring biased toward the driven roller by a spring 87. The idler roller 89 is also rotated by a reducer belt drive train 91 attached to the driven roller 85. A tension spring 96 maintains the drive train 91 taut. As the coil approaches, the idle roll is forced open by the coil and the roller pair provide a pinching force as well as a driving force to flatten and eject the coil onto a discharge tray 93 (FIG. 1) and thus into a cart or container for disposal.

Figure 5:
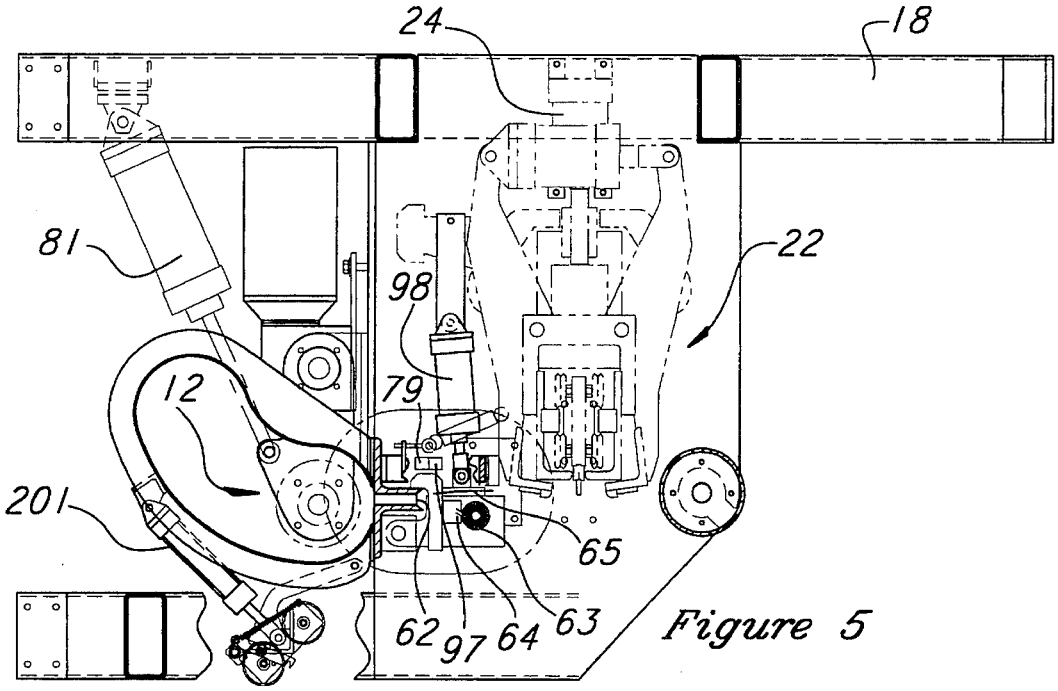
FIG. 5 is an enlarged detail of the preferred cutting and wrapper removal apparatus.

If the inner end of the wrapper glued to the newsprint paper does not pull free, the presence of the newsprint paper entering the mandrel assembly will be sensed by a light/dark photo sensor 97 (FIG. 5). The sensor will then close a circuit causing the carriage 18 to be raised. In effect, the newsprint paper is then torn free near the glue bead of the wrapper end W1.

A complete operation of the apparatus will now be described. A roll such as a newsprint paper roll R1, enters the turning rollers 32 and is cushioned to a stop in a conventional manner. Carriage 18 is then moved down until the proximity photo sensor 34 senses the top of the roll. The carriage will stop just prior to contact of the roll by the rider roller 30. The roll will then be rotated in the unwinding direction at a reduced speed. When the outer end WO of the wrapper approaches a hook arm 103, the hook arm catches the end of the wrapper and is swung counterclockwise (FIG. 12) to actuate a magnetic reed switch 102, setting a timer to rotate the roll to position the tail WO at nominally eleven o'clock as shown in FIG. 11B. When the tail is prepositioned, the carriage 18 will continue down until supported by the rider roller 30 against the roll.

The cutter assembly is then driven down by the pneumatic cylinders 24 until the open grippers contact the wrapper. Constant downward pressure is maintained by the cylinders 24 and by pneumatic cylinders 25 while the pinch bars are closed by extension of the cylinders 28. Cylinders 25 are fixed to the main frame 10 and normally are not energized. The cylinders 25 stroke freely when the carriage 18 is raised and lowered but are pressurized when adding gripping pressure to the pads 26.

The pinching action forms the longitudinal (or axial) bubble in the wrapper. After a short time delay, the cutter blade is driven laterally along the length of the bubble, slitting or tearing the wrapper. After completing the cut, the air showers are activated, the brush begins to rotate, and the roll is turned slowly in the wind (counterclockwise) direction. Then as described earlier, the roll continues to be rotated by the rollers 32 until the entire wrapper has been removed and coiled on the forks 72 of the coiling mandrel 12. The coil will then be loosened on the mandrel, the collecting rollers will close and draw the coil off the mandrel forks. The pinch rollers will then pinch the coil into a flat shape and discharge it down the chute 93. The cutter assembly will be raised, and eventually the carriage will be raised. The paper roll then will be ejected from the turning rollers after the coil has been ejected from the pinch rollers.

The method of the invention is also best shown schematically by referring to FIGS. 11A–11F. The steps include rotating a roll wrapped with one or more wraps of the wrapper until the outer edge of the wrapper is prepositioned, creating an axial bubble in the wrapper, automatically moving a cutting knife having a beveled tip, along a predetermined cutting path to penetrate beneath the crown of the bubble, but above the surface of the underlying wraps, and at a location circumferentially along the wrapper a predetermined distance from the sensed outer end of the wrapper. Then the cutting knife is moved through the bubble from one end of the roll to the other, tearing the wrapper open from the inside out next while rotating the roll the cut severed end of the wrapper is guided to a collecting or gathering location. At the gathering location, the wrapper is wound into a coil and then the coiled wrapper is removed from the gathering location for discharge. The method includes detecting if the newspaper paper is attached to the cut wrapper and separating the newsprint from the wrapper if the newsprint is accidently so attached to the wrapper.

FIGS. 13–24 illustrate a second embodiment of the invention.

Figure 13:
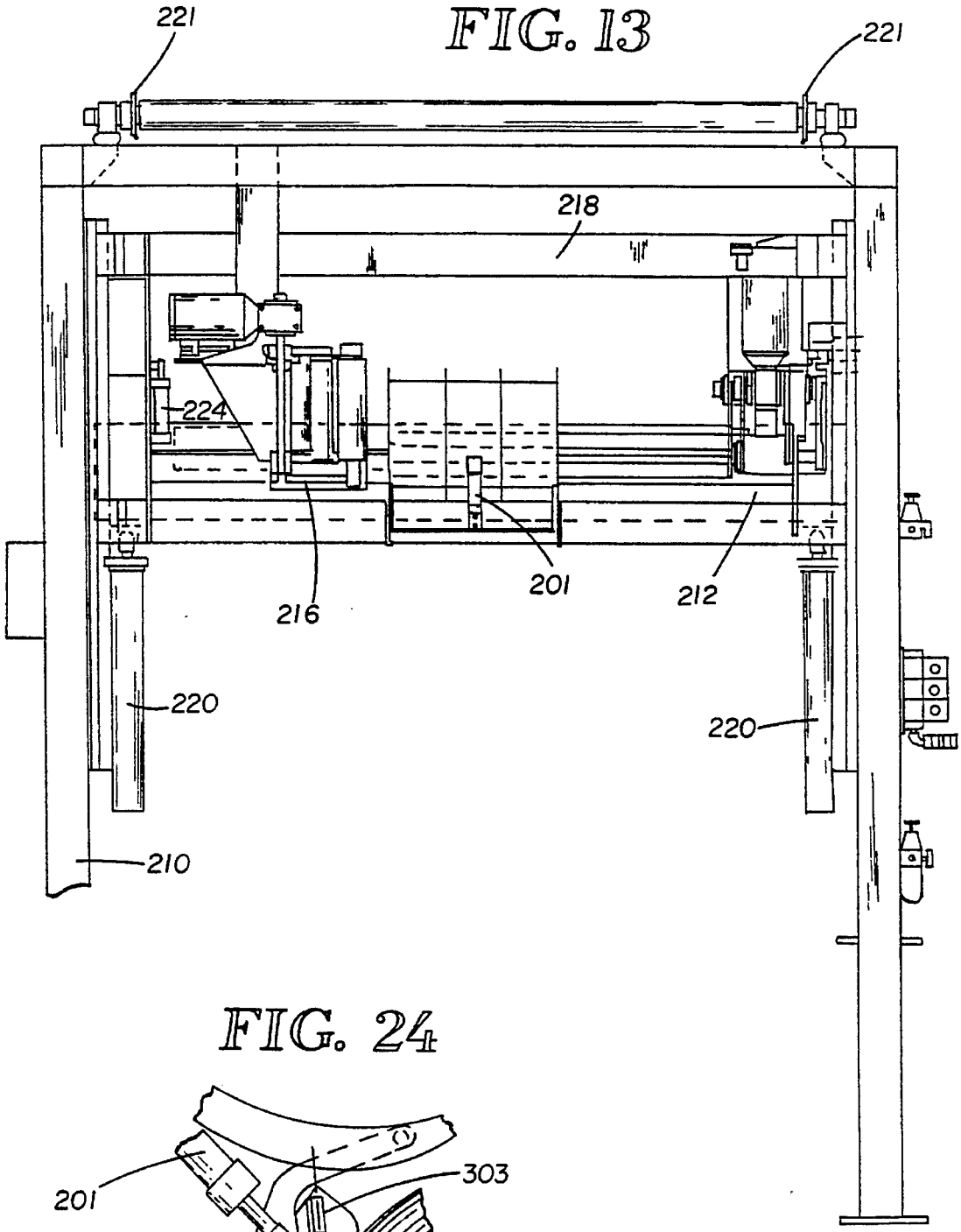
FIG. 13 is a front elevation of a second embodiment of the apparatus for cutting and removing the wrapper.
Figure 24:
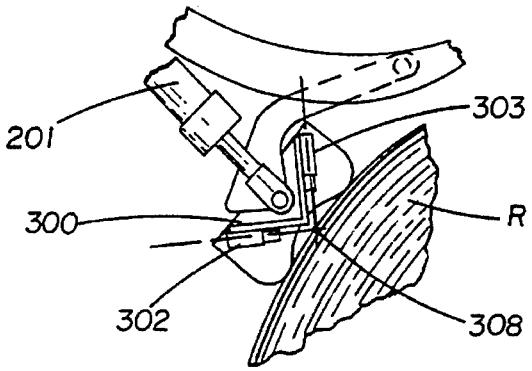
FIG. 24 is a fragmentary view of a sensor for locating the outer or trailing edge of the wrapper in the second embodiment.

FIG. 13 illustrates a main frame 210 having a cut wrapper collecting mandrel assembly 212, an air shower tube 213 (FIG. 15) for guiding the cut wrapper into the mandrel assembly, and a wrapper removing assembly 216 for stripping the cut wrapper from off of the mandrel assembly 212.

As best shown in FIG. 14 the main frame 210 also supports a cutter carriage 218 vertically and reciprocally mounted. A pair of cylinders 220 raise and lower the carriage via chains and sprockets 221. A movable cutter assembly 222 is raised and lowered on the carriage 218 by a set of hydraulic cylinders 224.

As will be described in more detail below, the roll will then be rotated at half speed until the outer edge of the wrapper is located on the roll. This is done to position the cutter at the lapped area of the wrapper in the unglued area.

The carriage 218 is provided with a rider roller 230 which, when the carriage is lowered, will move down therewith into engagement with a paper roll R located on a pair of rotatable turning rollers 232. The roll will have a wrapper of one or more wraps surrounding the paper of the roll. The rollers are capable of handling wrapped rolls of various handling wrapped rolls of various diameters such as the second wrapped roll shown in phantom lines R2.

Figure 15:
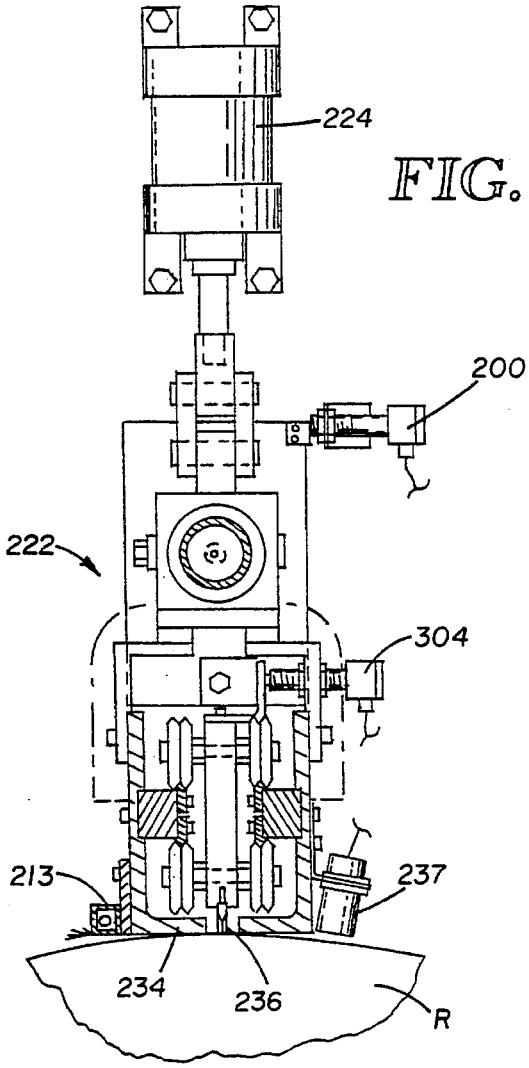
FIG. 15 is an end elevation of a portion of the second embodiment showing the wrapper cutting blade.
Figure 22:
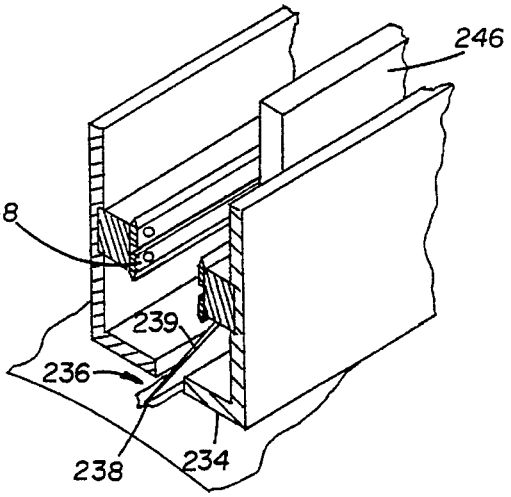
FIG. 22 is an isometric of the cutting blade of the second embodiment.
Figure 16:
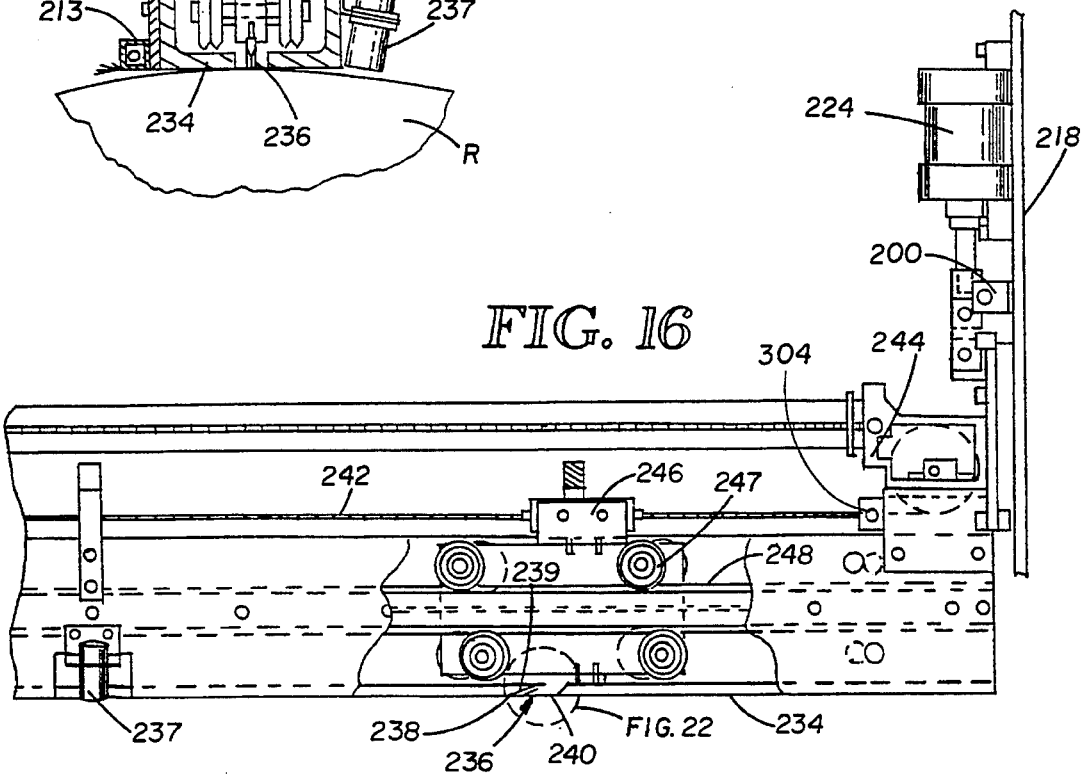
FIG. 16 is a side elevation of a portion of the second embodiment.

The cutter assembly 222 is best shown in FIGS. 15 and 16 and includes a set of gauge rails 234 to position a cutter blade 236. The cutter carriage 218 will stop downward movement when the rider roller engages the roll R. A photo-capacitive sensor 237 will then sense the presence of the roll R on the rollers 232 and activate the pneumatic cylinders 224 to lower the cutter assembly until the gauge rails 234 are positioned directly on the surface of the wrapper W on the roll. The gauge rails are spaced apart sufficient to allow the forward tip of the cutter blade 236 to enter beneath the outer wrap of the wrapper between 0.011–0.016 inches below the radially outer surface of the wrapper. The cutter blade has a beveled tip 238 (FIG. 22) sloping up and rearwardly to an edge 239 and sloping down on either side from the edge to a flat guide surface 240. The blade thus is intended to be slipped in from an end of the roll under the outermost wrap of the wrapper and tear the wrapper by pushing out from within. In this way, the flat guide surface 240 cannot penetrate beyond the wrap on which it lays when the blade is inserted and the continued movement of the blade from the one end of the roll to the other will have no occasion to penetrate further into the next radially inward wrap of the wrapper. In this way it is highly unlikely that any more than the top wrap or the first two wraps of the wrapper will be torn open by the blade and the newsprint paper will not be engaged by the blade. The spacing between the gauge rails 234 is such that the curvature of the roll will be slightly above the bottom surface of the guide rails in the gap between the guide rails and the blade is set to be at the precise dimension given above. This position, of course, can be adjusted if necessary for various types of wrappers.

The cutter blade 236 is propelled through the wrapper from one end of the roll to the other by an endless cable drive 242 (FIG. 16) driven by a pneumatic cable cylinder 244. The cable is fixed to a trolley 246 having a plurality of guide wheels 247 that move on a guide track 248. Thus, by actuating the pneumatic cylinder 244, the blade can by moved along the guide track 248 the full length of a roll.

Once the roll wrapper has been cut all the way through, the cutter blade is retracted to its original position spaced endwise from the roll, the cutter carriage 218 is raised, and the rollers 232 are rotated to rotate the roll R in the counterclockwise direction as shown in FIGS. 14 and 15.

The air shower tube 213 emits a generally horizontal stream of air to the left as shown in FIG. 15. As the air passes over the cut free end of the wrapper, the free end is lifted by the air stream and guided into a guide slot 262 (FIG. 17). The cut free end of the wrapper is moved to the left in FIG. 17 by the counterclockwise rotation of the roll R and the air stream from the air stream tube 213 and is drawn up against the surface of the guide bar 261 over the support bar 260 and then into the slot 262. After passing through the slot 262, the free end of the wrapper enters the gap between the spaced forks 272 of the cut wrapper collector mandrel assembly 212.

A web sensing photo sensor 279 signals the presence of the wrapper just before it enters the coiling mandrel 212. After a short delay the mandrel will start to rotate. The mandrel is best shown in FIGS. 18 and 19 and includes a motor 270 that rotates a pair of forks 272 carried on a spindle 274. Spindle 274 is driven by a drive belt 276 driven by the motor. The cut wrapper is then fed through the gap or nip 278 between the forks and as the forks rotate the wrapper becomes wrapped around the forks in a coil. The mandrel motor is designed to accelerate to its final speed and once it reaches that speed immediately begins to decelerate slowly. This is to prevent over-tightening of the wrapper coil on the forks. The deceleration curve will be in the range of 50 seconds.

When the wrapper is completely unwound from the roll R, the glue holding the inner end of the wrapper W to the roll should release and the inner end of the innermost wrap of the wrapper should pull free. As the inner end of the wrapper feeds past the web sensing photo sensor 279, the sensor will open a circuit, stopping the turning rolls 232 thus bringing the rotation of the roll R to a stop and starting a short time delay. After this delay, the mandrel motor will decelerate to a very slow indexing speed and then will shut off with the mandrel forks aligned vertically as shown in FIG. 11D.

A cylinder 283 swings the motor and forks clockwise as shown in FIG. 18 away from the roll and raises it into alignment with the collecting roller assembly 216.

Figure 20:
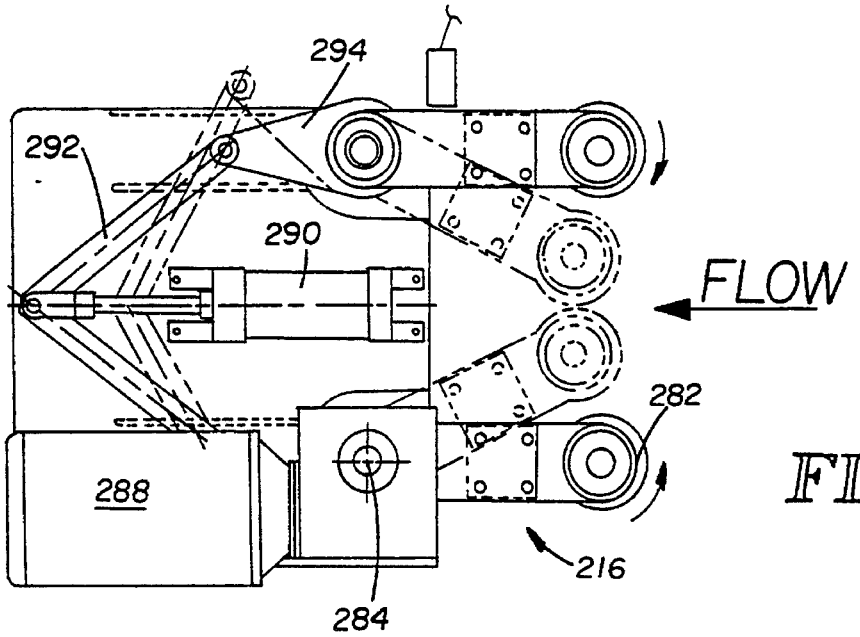
FIG. 20 is a plan of the second embodiment of the apparatus for removing the wrapper from the wrapper collecting mandrel.
Figure 21:
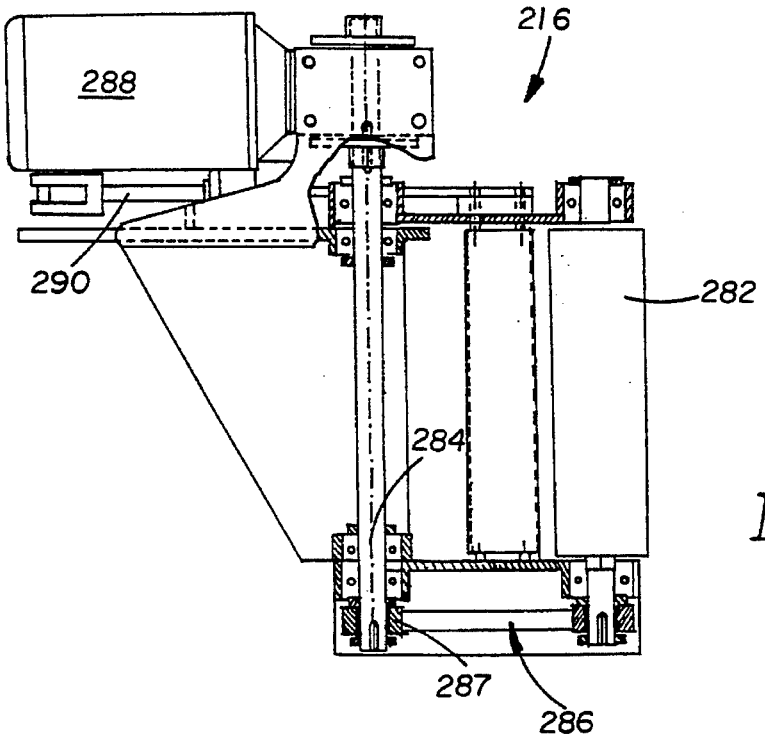
FIG. 21 is a side elevation of the apparatus shown in FIG. 20.

The collecting roller assembly 216 is best shown in FIGS. 20 and 21 and includes a set of vertical rollers 282 pivotally mounted on a pivot rod 284 and rotatably driven by belt 286. The belt is carried on sheaves 287 mounted on the pivot rod 284. The pivot rod is rotated by a motor 288. A cylinder 290 connects to linkages 292 and 294 to pivot the rollers toward one another. One roller 282 is driven so that the wrapper can be caught between the nip between the two rollers when the rollers are moved toward one another. The wrapper is thus pulled or stripped off of the mandrel forks. The coil is flattened and driven away from the machine to be received by a cart or container for disposal.

If the inner end of the wrapper glued to the newsprint paper does not pull free, the presence of the newsprint paper entering the mandrel assembly will be sensed by a light/dark photo sensor 297 (FIG. 17). The sensor will then close a circuit to actuate a conventional tail cutter which will cut off the newsprint paper. The tail cutter employs a cylinder 298 (FIG. 14) which is connected to the guide bar 260 that carries an elongated wire 299. The wire runs the length of the roll and is a conventional paper cutting wire. When the wire cutting cylinder piston rod is lowered, the wire is passed down past the guide slot 262 to sever the newsprint.

The operation of the apparatus is now described. A roll such as a newsprint paper roll R, enters the turning rolls 232 and is cushioned to a stop in a conventional manner.

A bracket 300 carries a light source 303 and a photo sensor 302 and is pivoted toward the roll by the cylinder 201. The light 303 is directed at the surface of the wrapper. The roll will be rotated in the unwinding direction at a reduced speed. When the outer end 308 of the wrapper passes beneath the light, it creates a shadow. The shadow is detected by the photo sensor 302. Once the photo sensor 302 finds the wrapper outer end, the turning rolls 232 stop and the cutter assembly 222 is lowered onto the roll.

The cutter carriage 218 is then lowered by the cylinders 220 until the downward motion of the cutter carriage is stopped by the rider roll 230 contacting the roll of newsprint paper. The capacitive proximity sensor 237 (FIG. 15) on the cutter carriage will sense the roll of newsprint paper causing the cutter assembly 222 to be raised by the cylinders 224 relative to the carriage 218. When the cutter assembly 222 is raised to its upper position, it activates a photo sensor 200. The sensor 200 then signals to begin, slowly rotating the roll counterclockwise to assure the desired overlap is at the cutting path.

The cutter assembly gauge rails 234 will rest on the roll so that the tip 238 of the cutting blade 236 is positioned beneath the outermost wrap on the roll as determined by the gauge rails and beyond the glue area as was determined by the location of the outer end of the wrapper by sensor 302. The lowered presence of the cutter assembly 222 is detected by a sensor 304 which activates the cable cylinder to drive the trolley 246 and cutter blade. The cutter blade then travels along the top of the roll, slitting the wrapper. After the wrapper is cut, the cutter assembly is raised, the air shower is emitted from tube 213. The roll is then turned in the unwind direction slowly. The air shower flows over the leading cutting edge of the wrapper, drawing it up and guiding it through the wrapper guide slot 262. The web sensing photo sensor 279 will then signal the presence of the wrapper just before it enters the forks 272 of the coiling mandrel 212. After a short delay, the mandrel will start to rotate as discussed earlier.

When the wrapper is completely unwound from the roll the glue holding the wrapper to the roll should release and the end of the wrapper should pull free. As the tail of the wrapper feeds past the web sensing photo sensor 279, the photo sensor will open a circuit stopping the turning rolls 232 and starting a short time delay. After this delay, the mandrel motor will decelerate to index speed and then shut off with the mandrel forks aligned vertically.

If the wrapper does not pull free as described earlier, the newsprint paper will be fed through the wrapper guides and sensed by the light/dark photo sensor 297. The photo sensor will actuate the newsprint paper cutter cylinder 299 which will lower the wire 299 and cut off the newsprint paper. When the newsprint paper is cut, the turning rolls 232 will be shut off and the timer will be started as described above. After the time delay, the mandrel motor will be rotated to its indexed position and then shut off. The turning rolls will be reversed to wind up the free end of the newsprint onto the roll R.

After the mandrel motor is shut off, the cylinder 283 will swing the mandrel upward. The end of the coiled wrapper tube extending beyond the mandrel forks 272 will be fed between the discharge rollers 283. The discharge rollers will be closed on the end of the wrapper tube. The newsprint roll R will also be ejected from the turning rollers 232. After the discharge rollers 283 are closed, the discharge roller motor 288 will start. The discharge rollers will pull the wrapper tube off the mandrel forks, flattening the wrapper tube as it feeds through the rollers and will discharge the flattened wrapper tube into a bin or receptacle. As the wrapper tube is being discharged, the next roll R of newsprint enters the turning rollers and the sequence repeats.

The method of this invention is best shown schematically in FIGS. 23A–23D. The steps include rotating a roll wrapped with one or more wraps of a wrapper until the outer edge of the wrapper is located, automatically moving a cutting knife having a beveled tip, guided by gauge rails on the roll, along a predetermined cutting path to penetrate beneath the outer wrap at a predetermined distance circumferentially from the sensed wrapper outer edge, drawing the cutting knife through the wrapper from one end of the roll to the other, tearing the wrapper open from the inside out, and rotating the roll while guiding the cut severed end of the wrapper to a gathering location. At the gathering location, wrapping the wrapper into a coil and then stripping the coiled wrapper from the gathering location for discharge. The method includes sensing the presence of newsprint paper attached to the cut wrapper and cutting the newsprint if it is accidently so attached to the wrapper.

While the preferred and other embodiments of the invention have been illustrated and described, it should be apparent that variations will be apparent to one skilled in the art without departing from the principles herein. Accordingly, the invention is not limited to the form illustrated in the drawing.

We claim:

1. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position two spaced portions of the outer surface of the wrapper on opposite sides of the cutting path;

pushing said two spaced portions against the roll and toward each other along a pushing plane intersecting the roll to pinch the wrapper and push it outwardly of the roll into a raised bubble having an exposed crown extending radially outwardly of said pushing plane;

moving a blade through the bubble radially outwardly of the pushing plane that intersects the roll to cut the wrapper by cutting through the crown; and removing the cut wrapper.

2. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position two spaced portions of the outer surface of the wrapper on opposite sides of the cutting path;

pushing against said two spaced portions in radial and tangential directions toward each other along a curved plane to pinch the wrapper and form an outwardly raised bubble having an exposed crown extending above said curved plane;

moving a blade through the bubble to cut the wrapper by cutting through the bubble; said blade moving step including applying a cutting force with the blade from underneath the crown of the bubble and radially outwardly of the crown of the bubble along said predetermined cutting path starting at one end of the roll and along the length of the roll along said predetermined cutting path; and removing the cut wrapper.

3. The method of claim 2, said step of pushing against the two portions including pushing simultaneously along the entire length of the roll.

4. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position two spaced portions of the outer surface of the wrapper on opposite sides of the cutting path;

pushing against said two spaced portions in radial and tangential directions toward each other along a curved plane to pinch the wrapper and form an outwardly raised bubble having an exposed crown extending above said curved plane;

moving a blade through the bubble to cut the wrapper by cutting through the bubble; said step of pushing against the two spaced portions including pushing simultaneously along the entire length of the roll; and removing the cut wrapper.

5. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position two spaced portions of the outer surface of the wrapper on opposite sides of the cutting path;

pushing against said two spaced portions in radial and tangential directions toward each other along a curved plane to pinch the wrapper and form an outwardly raised bubble having an exposed crown extending above said curved plane;

moving a blade through the bubble to cut the wrapper by cutting through the bubble; said wrapper having at least one outermost overlapping wrap and forming the bubble in said overlapping wrap, said blade having a narrow tip sloping radially outwardly of the roll along a cutting edge, said step of moving the blade beneath the crown of the bubble including inserting the tip under the bubble and cutting the wrapper by moving the cutting edge through the crown of the bubble spaced outwardly from the next innermost wrap and from one end of the roll to the opposite end of the roll to tear the wrapper from end-to-end of the roll; and removing the cut wrapper.

6. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position two spaced portions of the outer surface of the wrapper on opposite sides of the cutting path;

pushing against said two spaced portions in radial and tangential directions toward each other along a curved plane to pinch the wrapper and form an outwardly raised bubble having an exposed crown extending above said curved plane;

moving a blade through the bubble to cut the wrapper by cutting through the bubble and removing the cut wrapper; said step of removing the cut wrapper including directing a stream of air past the cut end of the wrapper in a direction from the wrapper connection to the roll past the cut end of the wrapper to guide the wrapper to a removing location and simultaneously rotating the wrapped roll to free the wrapper from the roll while gathering the cut wrapper.

7. The method of claim 6, further including rotating the roll to move the cut end of the wrapper along with the roll, and engaging the cut end with a brush rotating in a direction opposite to the rotational direction of the roll to lift the cut end further off the roll.

8. The method of claim 7, including directing a second stream of air at the cut edge in a direction opposite the rotational direction of the roll to also lift the cut end off the roll.

9. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position two spaced portions of the outer surface of the wrapper on opposite sides of the cutting path;

pushing against said two spaced portions in radial and tangential directions toward each other along a curved plane to pinch the wrapper and form an outwardly raised bubble having an exposed crown extending above said curved plane;

moving a blade through the bubble to cut the wrapper by cutting through the bubble; said roll being a roll of paper, including the step of sensing the presence of paper in the roll attached to the cut wrapper and cutting the roll paper from the cut wrapper at a location spaced from the wrapper predetermined cutting path; and removing the cut wrapper.

10. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position two spaced portions of the outer surface of the wrapper on opposite sides of the cutting path;

pushing against said two spaced portions in radial and tangential directions toward each other along a curved plane to pinch the wrapper and form an outwardly raised bubble having an exposed crown extending above said curved plane;

moving a blade through the bubble to cut the wrapper by cutting through the bubble and removing the cut wrapper; said step of removing the cut wrapper including directing air past the cut end of the wrapper including directing air past the cut end of the wrapper to guide the wrapper to a removing location and simultaneously rotating the roll to free the wrapper from the roll while gathering the cut wrapper, and said step of gathering the cut wrapper including entwining the wrapper on prongs and pulling the entwined wrapper off the prongs when the entire wrapper has been gathered by pinching the entwined wrapper between opposed counter rotating rollers.

11. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position two spaced portions of the outer surface of the wrapper on opposite sides of the cutting path;

pushing against said two spaced portions in radial and tangential directions toward each other along a curved plane to pinch the wrapper and form an outwardly raised bubble having an exposed crown extending above said curved plane;

moving a blade through the bubble to cut the wrapper by cutting through the bubble; including sensing the location of the outer end of the wrapper and inserting the blade under the bubble at a fixed circumferentially spaced distance from the sensed outer end of the wrapper; and removing the cut wrapper.

12. The method of claim 11 wherein the location of the outer edge of the wrapper is sensed by moving the outer edge past a hook switch actuator, and catching the edge against the actuator to signal the location of the outer edge at the actuator.

13. The method of claim 11 wherein the outer edge of the wrapper protrudes radially outwardly of the roll and wherein the location of the outer edge of the wrapper is sensed by moving the outer edge past a light source, the light source directed at a right angle to the edge to cast a shadow beyond the edge as the edge passes the light source, and detecting the shadow out by the edge to signal the location of the outer edge.

14. A method of cutting and removing a wrapper from a cylindrical roll having a protective wrapper around substantially the entire surface of the circumference of the roll, comprising:

positioning a cylindrical roll with a wrapper having an outer surface at a wrapper removing station;

rotating the roll about its longitudinal axis at the removing station until the outer end of the wrapper is located with respect to a predetermined cutting path to position tyro spaced portions of the outer surface of the wrapper on opposite sides of the cutting path;

pushing against said two spaced portions in radial and tangential directions toward each other along a curved plane to pinch the wrapper and form an outwardly raised bubble having an exposed crown extending above said curved plane;

moving a blade through the bubble to cut the wrapper by cutting through the bubble and removing the cut wrapper; said step of removing the cut wrapper including:

rotating the roll to move the cut end of the wrapper along with the roll, and engaging the cut end with a brush rotating in a direction opposite to the rotational direction of the roll to lift the cut end further off the roll; and including directing a second stream of air at the cut edge in a direction opposite the rotational direction of the roll to also lift the cut end off the roll.

15. The method of claim 14, said step of removing the cut wrapper including entwining the cut wrapper into a coil, removing the coil by pulling the coil axially of the length of the coil, and flattening the coil.

16. Apparatus for cutting and removing a wrapper from a cylindrical roll having opposite ends having a wrapper covering substantially the entire surface of the circumference of the roll with at least one outer overlapping wrap having an outer surface comprising:

means for rotating a wrapped roll about its longitudinal axis;

blade means for cutting through the wrapper, the blade means being located along a cutting path;

means having one side facing the roll and a second side facing away from the roll for pressing the wrapper against the roll on opposite sides of the cutting path both inwardly of the roll and tangentially of the roll, and toward each other to pinch the wrap radially outwardly to form an exposed bubble radially outwardly of the second side of the pressing means and having an exposed crown;

means for moving the blade means along the length of the bubble that extends outwardly from the second side of the pressing means to cut the wrapper by engaging the crown with the blade means; and means for removing the cut wrapper.

17. The apparatus of claim 16, wherein said pressing means extend the full length of the roll to form a single bubble along the full length of the roll.

18. The apparatus of claim 16, including means for sensing the outer end of the wrapper on the roll and means for locating the blade means a predetermined distance along the circumference of the roll from the sensed outer end of the wrapper.

19. The apparatus of claim 18, said means for sensing the outer edge including hook means for engaging the outer edge and signalling the location of the outer edge.

20. The apparatus of claim 16, said means for removing the cut wrapper including wrapper gathering means and means for directing air along the cut wrapper for lifting and guiding the wrapper to the wrapper gathering means.

21. The apparatus of claim 16, said means for locating the outer end of the wrapper including a light source directed to strike the outer end of the wrapper and sensing means for detecting a shadow caused from the light striking the outer end of the wrapper where it joins the next inner wrap.

22. The apparatus of claim 16, said means for removing the cut wrapper including gathering means for entwining the wrapper into a coil and roller means for engaging the coil, pulling the coil off the entwining means, and flattening the coil for disposal.

23. The apparatus of claim 16, said means for pressing the wrap to form a bubble including urethane pads having a 45 durometer (Shore A).

24. The apparatus of claim 23, said means for pressing the wrap to form a bubble including pads, and means for pivoting the pads long a pivot radius, into engagement with the wrap, said pads each having a wrap engaging surface curved to the radius of the pivot radius.

25. The apparatus of claim 16, said means for pressing the wrap to form a bubble including pads, and means for pivoting the pads along a pivot radius, into engagement with the wrap, said pads each having a wrap engaging surface curved to the radius of the pivot radius.

26. Apparatus for cutting and removing a wrapper from a cylindrical roll having opposite ends having a wrapper covering substantially the entire surface of the circumference of the roll with at least one outer overlapping wrap having an outer surface comprising:

means for rotating a wrapped roll about its longitudinal axis;

blade means for cutting through the wrapper, the blade means being located along a cutting path;

means for pressing the wrapper against the roll on opposite sides of the cutting path both radially inwardly of the roll and tangentially of the roll, and toward each other to pinch the wrap radially outwardly to form an exposed bubble radially outwardly of the pressing means and having an exposed crown;

means for moving the blade means along the length of the bubble to cut the wrapper by engaging the bubble with the blade means; said blade means having a single stationary blade with a sloped cutting edge facing radially outwardly and toward an end of the roll, said means for moving the blade including moving the edge of the blade under the crown of the bubble to apply a radially outwardly directed cutting force to the bubble; and means for removing the cut wrapper.

27. Apparatus for cutting and removing a wrapper from a cylindrical roll having opposite ends having a wrapper covering substantially the entire surface of the circumference of the roll with at least one outer overlapping wrap having an outer surface comprising:

means for rotating a wrapped roll about its longitudinal axis;

blade means for cutting through the wrapper, the blade means being located along a cutting path;

means for pressing the wrapper against the roll on opposite sides of the cutting path both radially inwardly of the roll and tangentially of the roll, and toward each other to pinch the wrap radially outwardly to form an exposed bubble radially outwardly of the pressing means and having an exposed crown;

means for moving the blade means along the length of the bubble to cut the wrapper by engaging the bubble with the blade means; said roll being a roll of paper, including means for sensing the presence of the paper from the roll attached to the cut wrapper as the wrapper is being removed, means for separating the paper from the cut wrapper; and means for removing the cut wrapper.

28. Apparatus for cutting and removing a wrapper from a cylindrical roll having a wrapper with at least one overlapping wrap around the circumference of the roll, comprising:

roll support rollers for rotating a wrapped roll about its longitudinal axis;

a single stationary blade with a narrow point and an outwardly sloping cutting edge;

a blade driver bar moving the blade with the point forward along the length of the roll along a cutting path;

a pair of urethane pads spaced along either side of the cutting path along the full length of the roll;

pivot arms pivotally mounting the pads;

pressing means for pushing the pads against the overlapping wrap and pivoting the arms toward one another to form a bubble having a crown spaced radially outwardly of the pads;

said pads having wrap engaging surfaces curved to the radius of pivoting of the pivot arms for engaging the wrap regardless of the diameter of the roll for firm frictional contact with the wrap; and the blade driver moving the blade through the crown of the bubble and spaced from the remainder of the roll.

29. Apparatus for cutting and removing a wrapper from a roll of printing paper with the wrapper having an inner end attached to the printing paper, comprising:

means for moving a cutter along and beneath the wrapper to form a cut wrapper;

means for removing the cut wrapper from the roll;

means for detecting the presence of printing paper attached to the inner end of the cut wrapper; and means for separating the printing paper from the cut wrapper.

* * * * *